US007179116B2

(12) United States Patent
Menard et al.

(10) Patent No.: US 7,179,116 B2
(45) Date of Patent: Feb. 20, 2007

(54) COLLAPSING BRIDGE CRIMP

(75) Inventors: Stephane Menard, Kirkland (CA); Jun Lu, LaSalle (CA)

(73) Assignee: Simpler Networks Inc., Dorval (CA)

( * ) Notice: Subject to any disclaimer, the term of this patent is extended or adjusted under 35 U.S.C. 154(b) by 0 days.

(21) Appl. No.: 11/146,638

(22) Filed: Jun. 7, 2005

(65) Prior Publication Data

US 2006/0166565 A1 Jul. 27, 2006

Related U.S. Application Data

(60) Provisional application No. 60/577,185, filed on Jun. 7, 2004.

(51) Int. Cl.
*H01R 11/20* (2006.01)

(52) U.S. Cl. ..... 439/442; 174/94 R; 439/423; 439/424

(58) Field of Classification Search ..... 439/877–882, 439/442, 203, 421, 423, 424, 430, 697, 720, 439/730, 741–742; 174/94 R, 84 C
See application file for complete search history.

(56) References Cited

U.S. PATENT DOCUMENTS

| | | | | |
|---|---|---|---|---|
| 2,296,443 | A * | 9/1942 | Kleinfelder | 403/390 |
| 3,408,455 | A * | 10/1968 | Dennie | 174/94 R |
| 3,410,950 | A * | 11/1968 | Freudenberg | 174/84 C |
| 3,546,366 | A * | 12/1970 | Toedtman et al. | 174/94 R |
| 3,767,841 | A * | 10/1973 | Anderson et al. | 174/84 C |
| 5,658,163 | A * | 8/1997 | DeRoss | 439/424 |
| 2005/0022360 | A1 * | 2/2005 | Villeneuve et al. | 29/513 |

* cited by examiner

*Primary Examiner*—Michael C. Zarroli
(74) *Attorney, Agent, or Firm*—Timothy J. Keefer; Seyfarth Shaw LLP

(57) ABSTRACT

The collapsing bridge crimp comprises a central portion and two mutually-opposite side arms extending from the central portion. Each side arm comprises a first portion attached to the central portion, the first portion being inwardly curved, and a second portion extending from the first portion and located above the central portion. The second portion of each side arm is substantially straight and defines an upwardly-oriented angle with reference to the central portion. The second portion also has a free end provided with an end face, the end face of both side arms defining a top-opened wire-receiving groove between them.

6 Claims, 12 Drawing Sheets

COLLAPSING BRIDGE CRIMP

CROSS-REFERENCE TO PRIOR APPLICATION

This application claims priority over U.S. patent application No. 60/577,185 filed Jun. 7, 2004 and entitled "Collapsing Bridge Crimp", which application is hereby incorporated by reference.

BACKGROUND

Some technical applications require that a length of wire be held at two or more points. For instance, in Electro-Mechanical Relays (EMR), it may be required that a heat-shrinkable wire be used. An example of a heat-shrinkable wire is one made of a nickel-titanium alloy. These wires are used in actuator mechanisms and enable significant cost and size reduction. However, heat-shrinkable wires such as nickel-titanium are very ductile and not bondable using traditional methods like welding, thermo-sonic bonding or ultrasonic bonding. They are also extremely small in diameter, typically between about 0.002" and about 0.012". There is thus a need to provide a reliable and simple way of attaching such fragile and small wires to the various structures.

SUMMARY

The present invention relates to a collapsing bridge crimp that is particularly well adapted for use with small and fragile wires.

In one aspect, there is provided a collapsing bridge crimp comprising: a central portion; two mutually-opposite side arms extending from the central portion, each side arm comprising: a first portion attached to the central portion, the first portion being inwardly curved; a second portion extending from the first portion and located above the central portion, the second portion being substantially straight and defining an upwardly-oriented angle with reference to the central portion, the second portion having a free end provided with an end face, the end face of both side arms defining a top-opened wire-receiving groove between them.

In another aspect, there is provided a method of securing a wire into a crimp having two mutually-opposite arms initially defining a wire-receiving groove between them on a top part of the crimp, the method comprising: inserting the wire in the groove on the crimp; allowing the wire to rest in a bottom part of the groove; and punching the crimp for closing the arms and squeezing the wire between end faces of the arms.

Further details of these and other aspects of the collapsing bridge crimp will be apparent from the following detailed description and accompanying figures.

BRIEF DESCRIPTION OF THE FIGURES

Reference is now made to the accompanying figures depicting aspects of the collapsing bridge crimp, in which.

DETAILED DESCRIPTION

Figure 1:
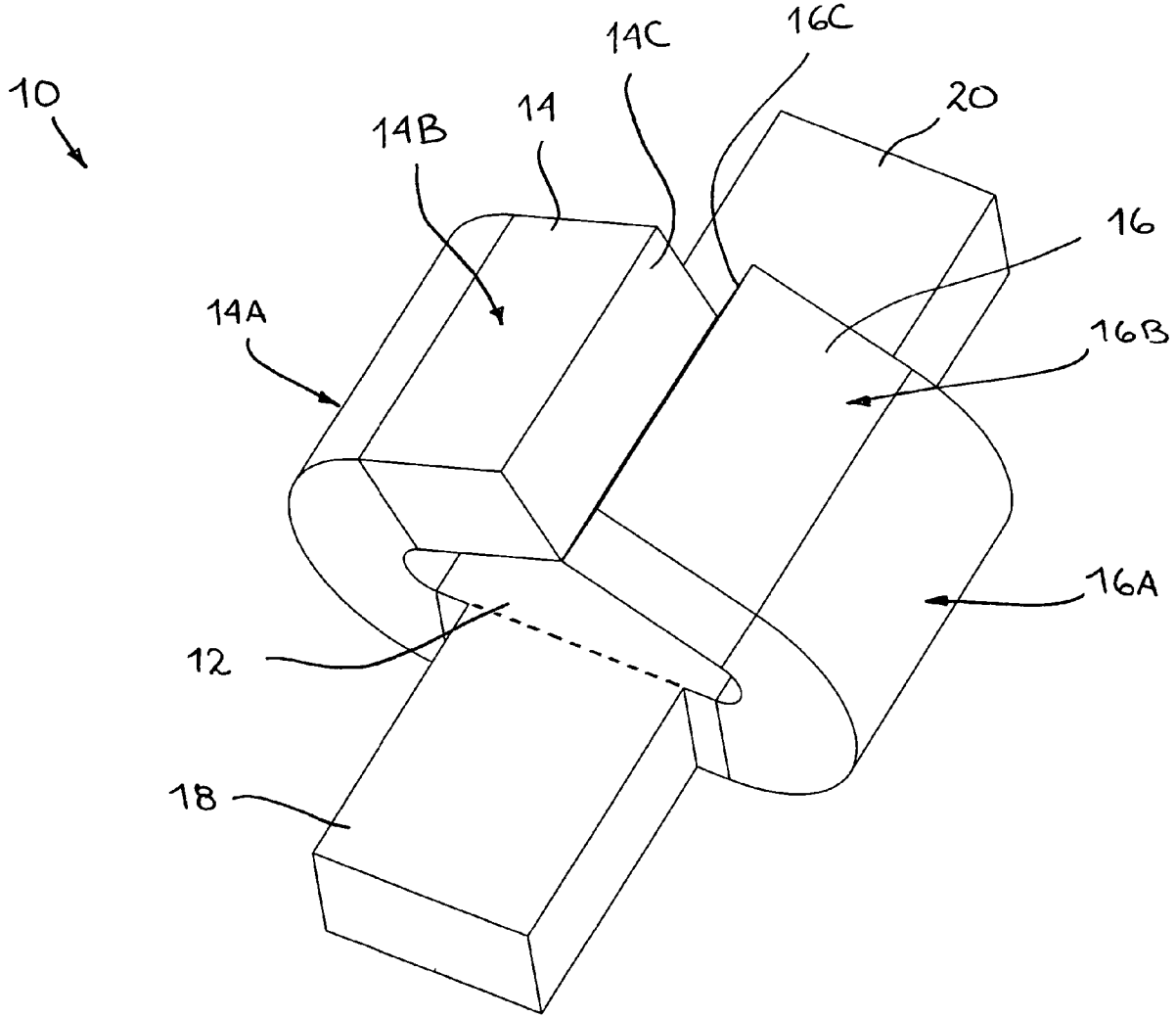
FIG. 1 is a perspective view of an example of a collapsing bridge crimp in accordance with a first possible embodiment.
Figure 2A:
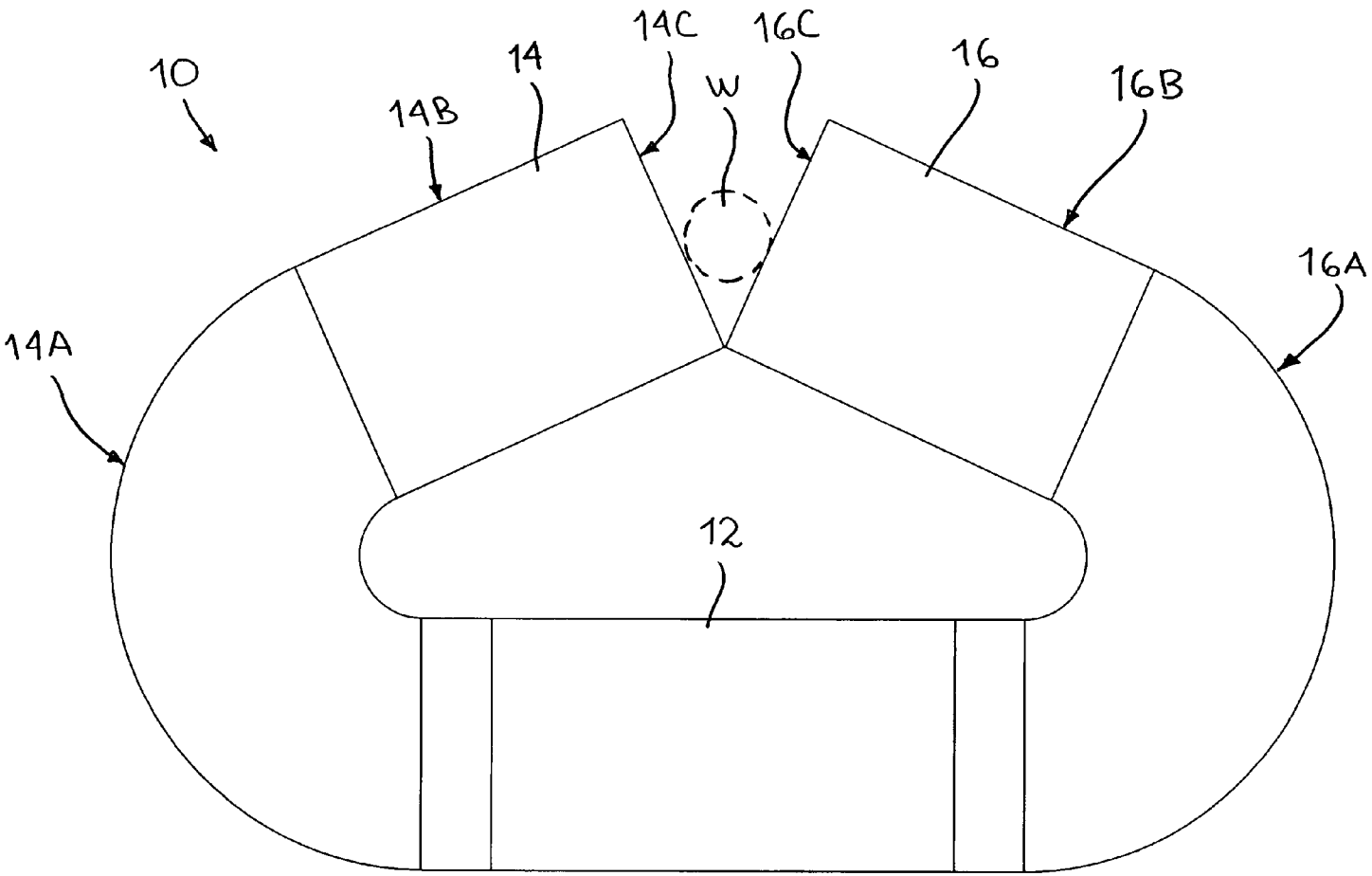
FIG. 2*a* is a side view of the crimp of FIG. 1.
Figure 2B:
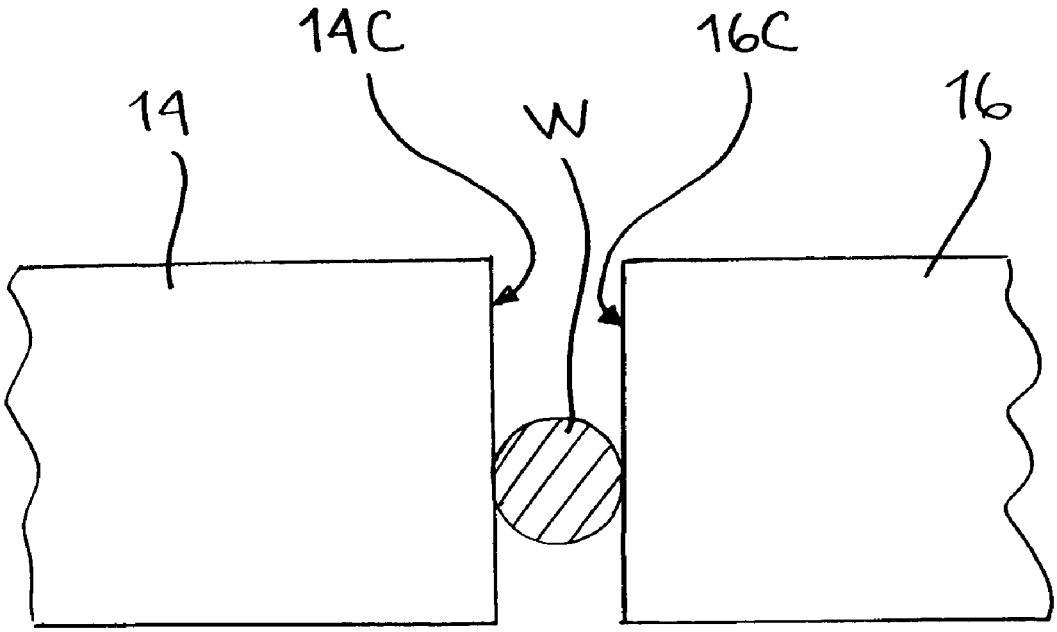
FIG. 2*b* is an enlarged view of upper part of the crimp of FIG. 2*a*, showing the crimp in a closed position after being punched to retain a wire between opposite side arms thereof.

FIGS. 1, 2*a* and 2*b* show an example of a collapsing bridge crimp in accordance with a first possible embodiment. This crimp, identified with reference numeral 10, is shown in an open position in FIGS. 1 and 2*a*, and in a closed position in FIG. 2*b*. It comprises a central portion (12) on the side of which two mutually-opposite and symmetrical side arms (14, 16) extend. The central portion (12) of the illustrated embodiment also comprises opposite side extensions (18, 20). These side extensions (18, 20) are only optional and may be useful during automated pick and place assembly. It should be noted that FIG. 1 shows a dotted line between the central portion (12) and one of the side extensions (18, 20) to better illustrate the approximate delimitation between them.

The illustrated crimp (10) is designed to be used in an electromechanical relay (EMR), such as the one disclosed in U.S. patent application No. 60/577,177 filed Jun. 7, 2004 and entitled "Electro-Mechanical Relay (EMR)", the content of which is hereby incorporated by reference. The crimp (10) can also be used with other EMR models or with other devices that are not EMRs.

Each of the side arms (14, 16) of the crimp (10) comprises a first portion (14A, 16A) attached to the central portion (12), and a second portion (14B, 16B) projecting from the corresponding first portion (14A, 16A). Each first portion (14A, 16A) is curved inwardly over more than 90°. Each of the second portions (14B, 16B) is substantially straight and is provided with an end face (14C, 16C) at a free end thereof. Initially, the second portions (14B, 16B) define an upwardly-oriented angle with reference to the central portion (12). The end faces (14C, 16C) are configured and disposed so that they define a wire-receiving groove between them, in this case a substantially V-shaped groove, opened at the top thereof. As shown in FIG. 2*a*, this allows inserting a wire (W) in the crimp (10). The wire (W) is then positioned in the middle of the bottom of the groove. It is maintained in place. Considering the size of the wire (W) used an EMR, the wire-receiving groove has a width, in a largest part thereof, that is typically between about 0.015" and about 0.075". The thickness of the side arms (14, 16) is dependent of wire diameter and retention required. It may generally range from 0.006" for a small wire up to 0.02" for a larger wire. Other dimensions are also possible.

The second portions (14B, 16B) of the illustrated embodiment have a rectangular cross-section and the end faces (14C, 16C) are substantially flat. The end faces (14C, 16C)

are also initially configured with their bottom edges being in contact with or otherwise very close to each other so as to retain the wire (W) prior to closure.

In use, to close the crimp (10), a force is applied over the second portions (14B, 16B) until both of them are horizontal or close to the horizontal. FIG. 2*b* shows that once closed, both side arms (14, 16) of the crimp (10) are designed so that the gap between the two end faces (14C, 16C) is somewhat smaller than the diameter of the wire (W). A force is thus applied by the side arms (14, 16) toward the center of the crimp (10), thereby providing a friction engagement holding the wire (W) between both end faces (14C, 16C). The retention force is proportional to the friction force of the end faces (14C, 16C) on the wire and such friction force is proportional to the normal force the end faces (14C, 16C) apply on the wire.

The crimp (10) can be closed very quickly using a force coming from a punching tool. Since the wire (W) is initially held at the bottom of the V-shaped groove, the relative position of the wire (W) will not vary significantly from one crimp to another. Therefore, the wire (W) can be installed very quickly with a high precision.

Figure 3:
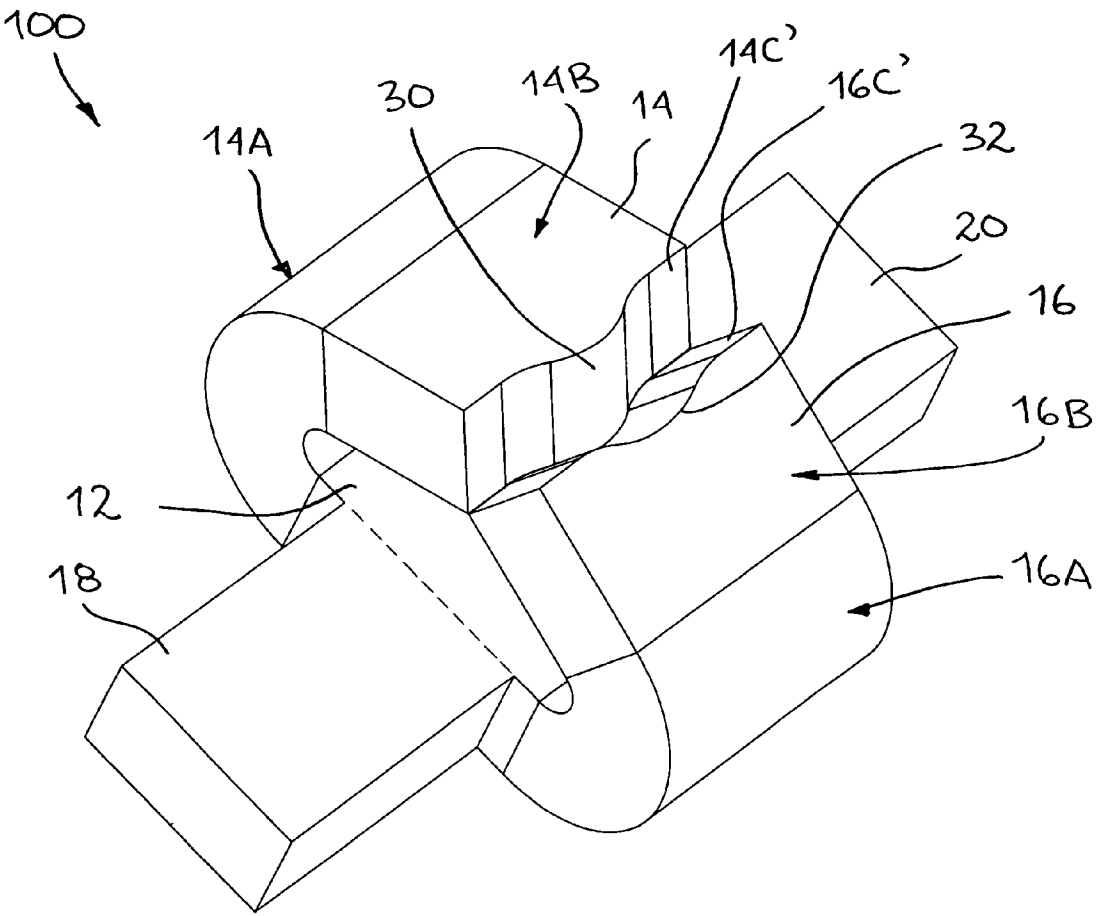
FIG. 3 is a perspective view of an example of a collapsing bridge crimp in accordance with another possible embodiment.
Figure 4:
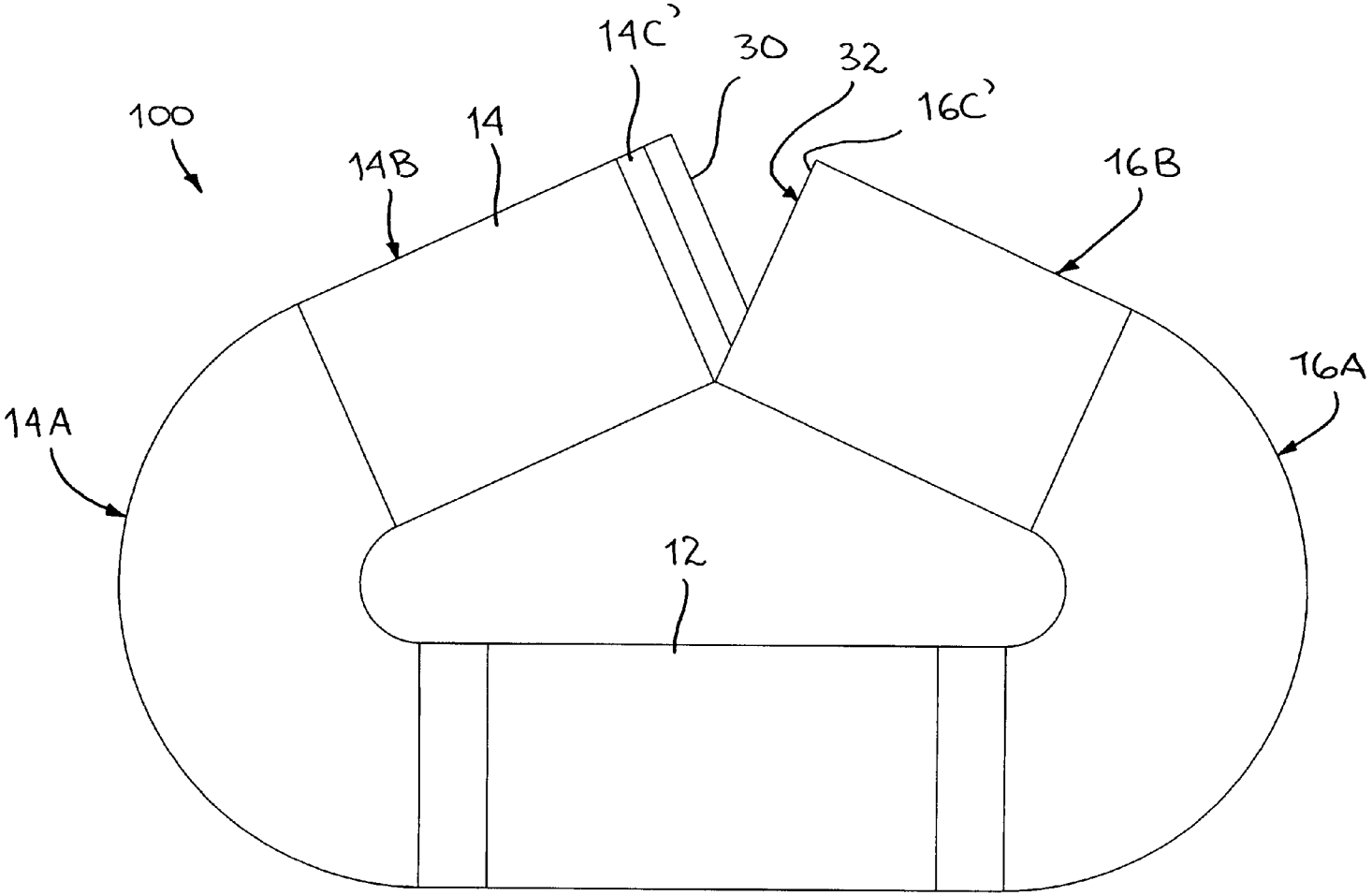
FIG. 4 is a side view of the crimp of FIG. 3.

FIGS. 3 and 4 show another model, which model is identified with the numeral 100. All the components are substantially identical to the ones of the previous crimp (10), with the exception of the end faces (14C, 16C), which are identified as (14C', 16C'). Instead of being substantially flat like in the first crimp (10), the end faces (14C', 16C') comprise at least one knob (30) in one of the end faces (14C', 16C'). Each knob (30) is configured and disposed to fit into a corresponding recess (32) made in an opposite one of the end faces (14C', 16C'). When closing the crimp (100) over a wire, each knob (30) creates a curved section in the wire placed therein. This will increase the retention of the wire and therefore, increase the maximum pulling force that it can withstand.

Figure 5:
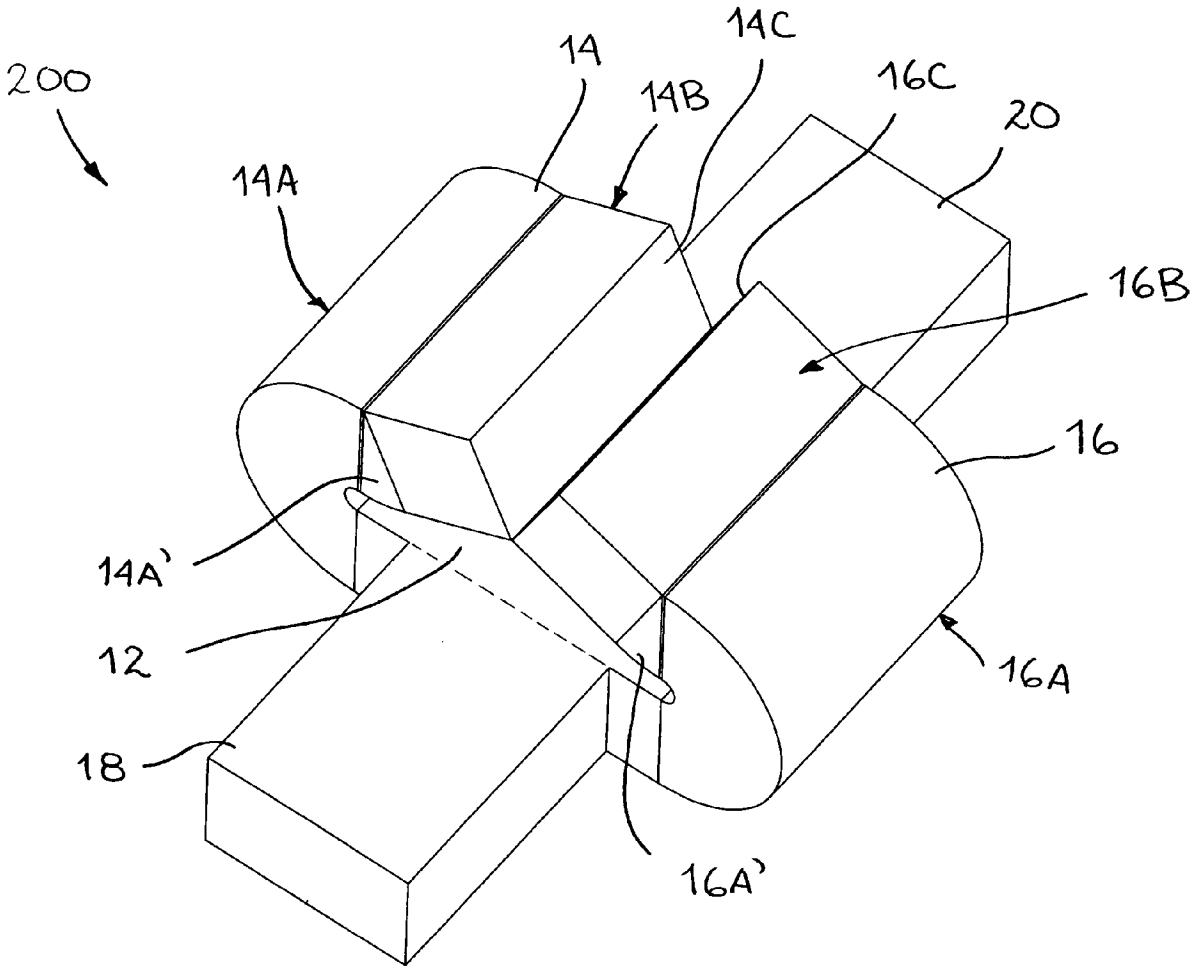
FIG. 5 is a perspective view of an example of a collapsing bridge crimp in accordance with another possible embodiment.
Figure 6:
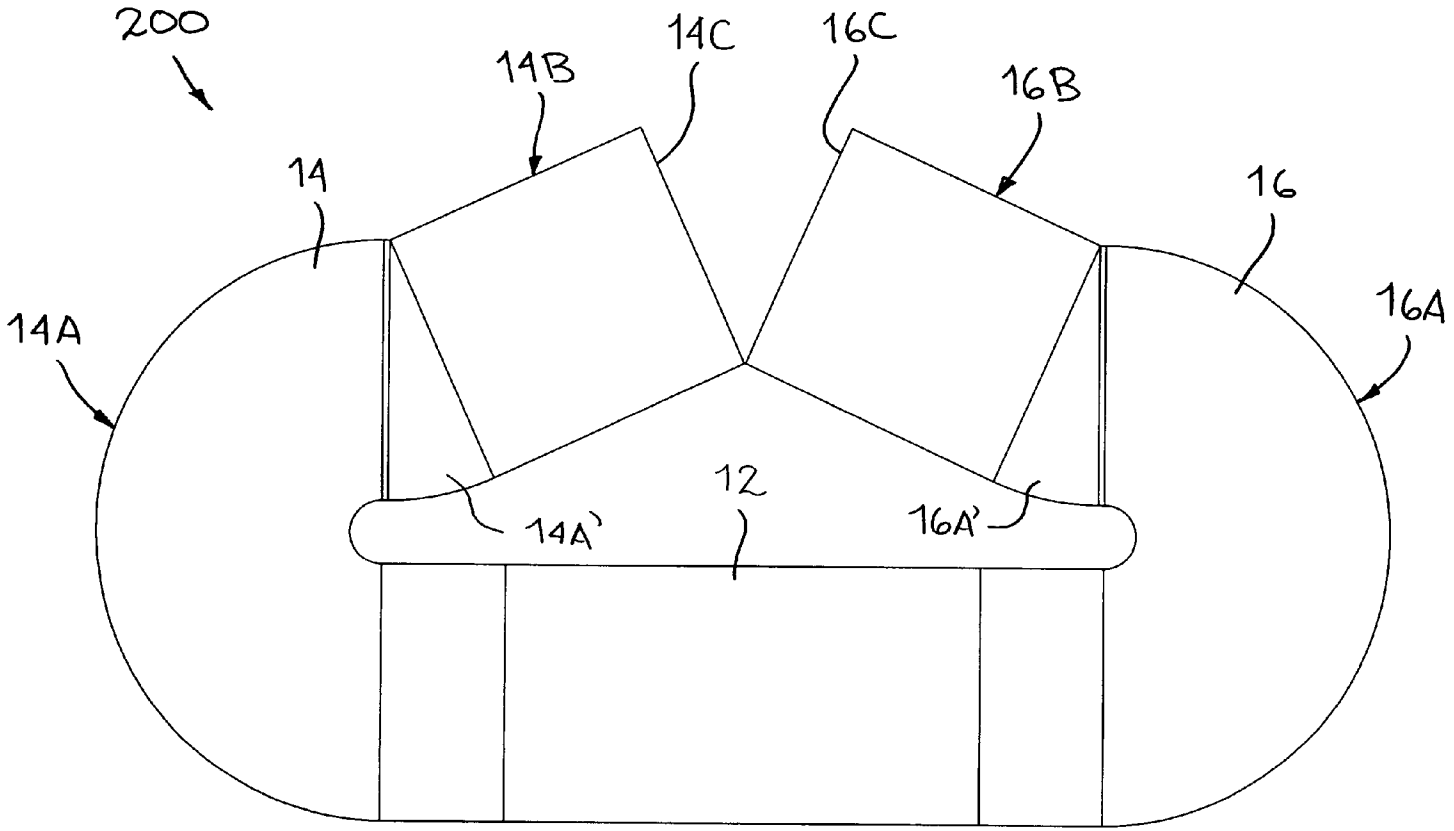
FIG. 6 is a side view of the crimp of FIG. 5.

FIGS. 5 and 6 show another example of a possible crimp model, which is identified with the numeral 200. This crimp (200) is also similar to the first model (10), with the exception that each side arm (14, 16) has, between the first portions (14A, 16A) and the second portions (14B, 16C), a third portion (14A', 16A') that is curved outwardly over less than 90°. These third portions (14A', 16A') provide a smaller radius of curvature around which the arms (14, 16) are bent when the crimp (200) is closed. Also, when closing the crimp (200), the side arms (14, 16) will have a lesser tendency to "open" towards the exterior. This increases the retention force of the crimp since the normal force applied by the end faces (14C, 16C) against the wire also increases.

Figure 7:
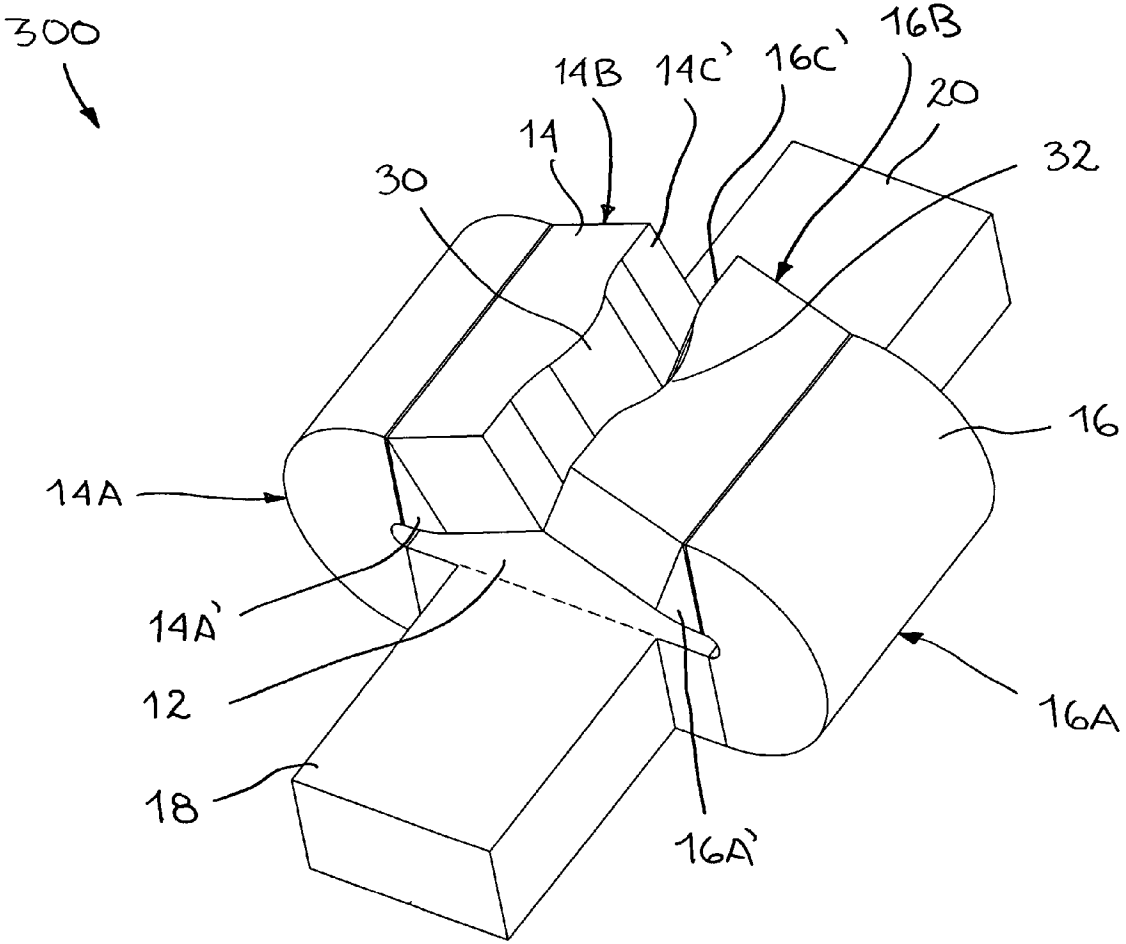
FIG. 7 is a perspective view of an example of a collapsing bridge crimp in accordance with another possible embodiment.
Figure 8:
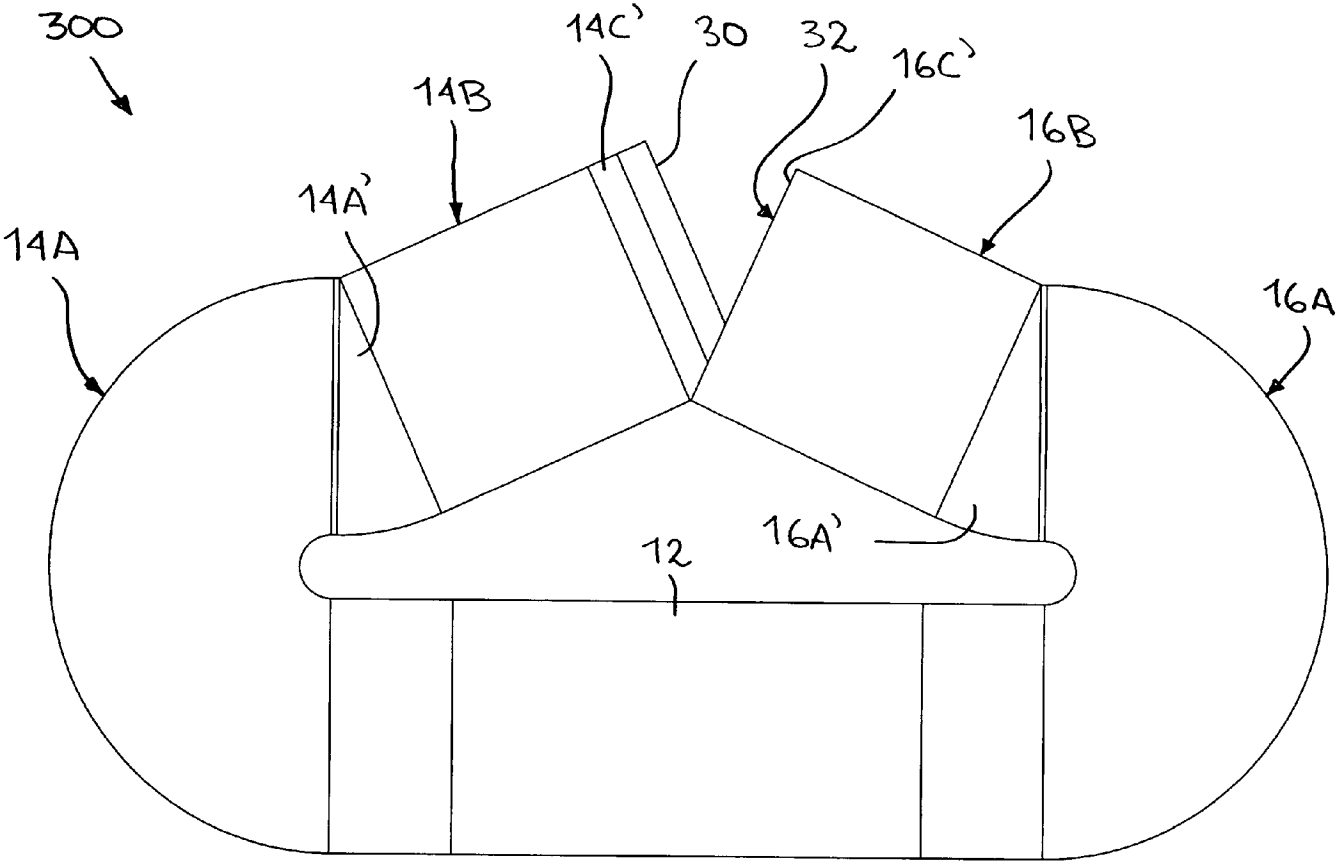
FIG. 8 is a side view of the crimp of FIG. 7.

FIGS. 7 and 8 show an example of a fourth possible crimp model, identified with reference numeral 300, which incorporates features of the three preceding embodiments. It thus comprises shaped-end faces (14C', 16C') and third portions (14A', 16A'). This crimp (300) provides an optimal retention of a wire.

Figure 9:
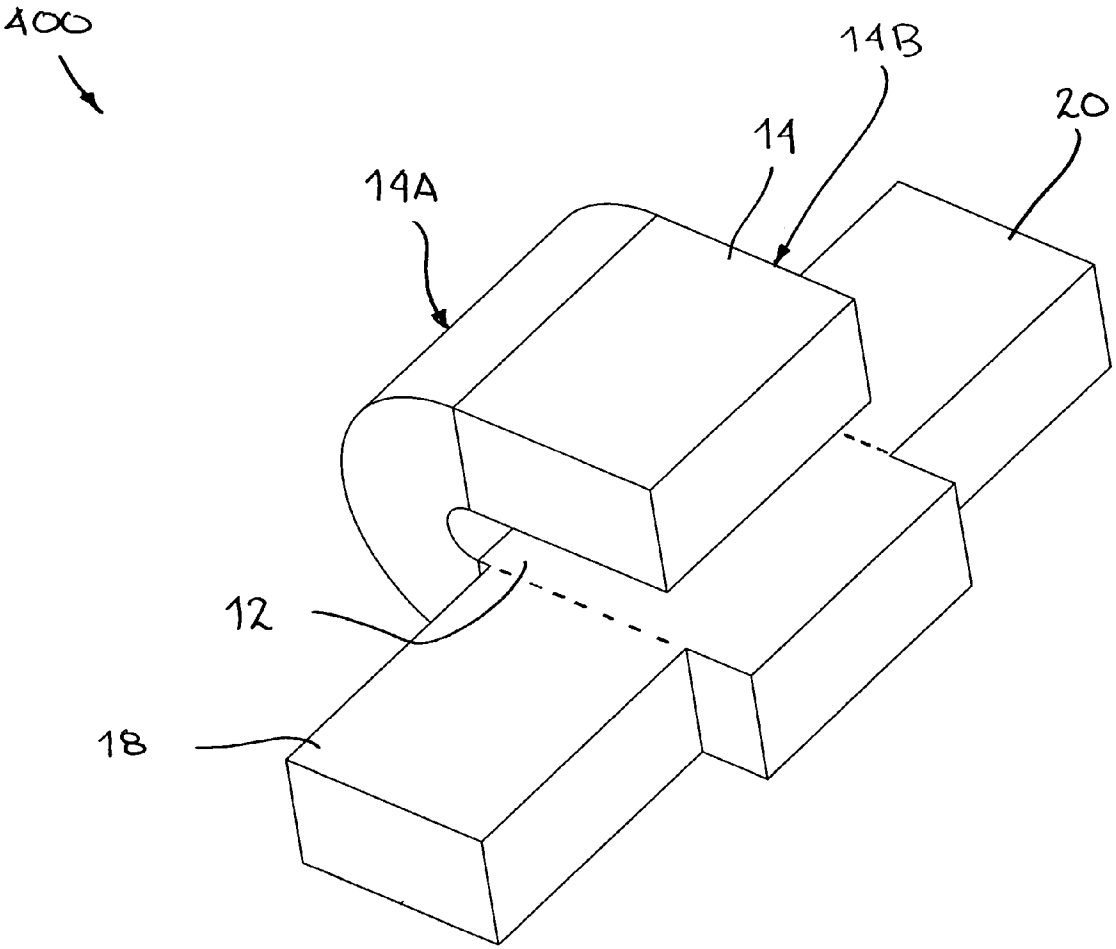
FIG. 9 is perspective view of an example of a collapsing bridge crimp in accordance with another possible embodiment.
Figure 10:
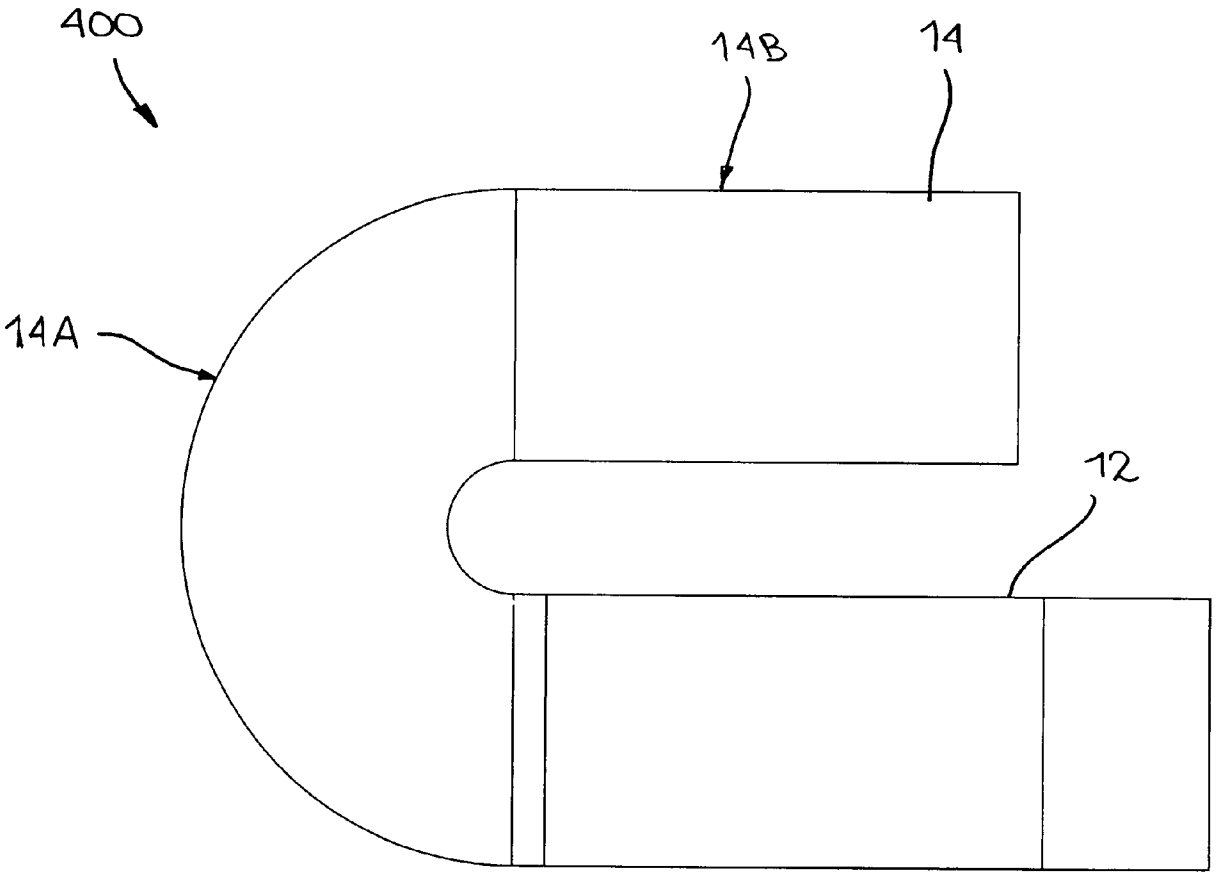
FIG. 10 is a side view of the crimp of FIG. 9.
Figure 11:
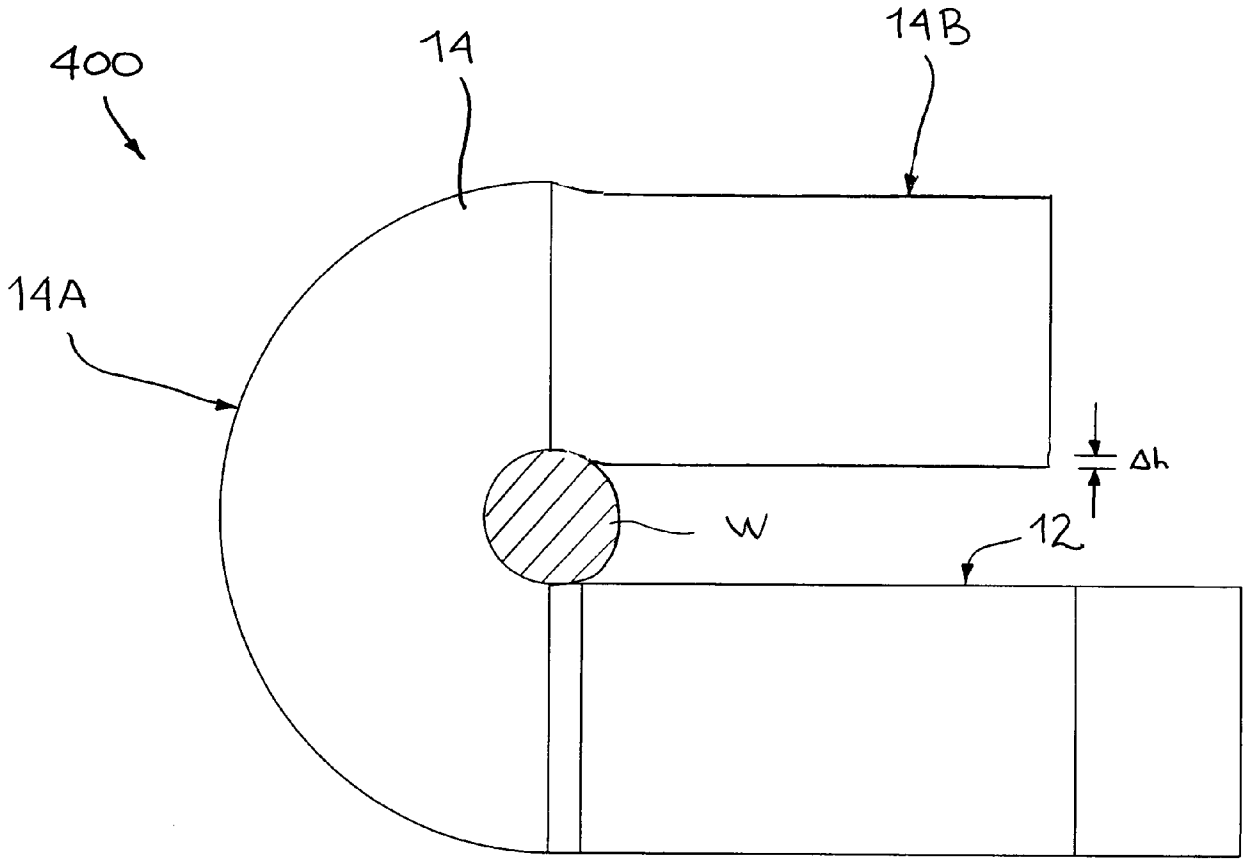
FIG. 11 is view similar to FIG. 10, showing the crimp in a closed position after being punched to retain a wire.

FIGS. 9 to 11 show an alternative model, identified with reference numeral 400, where only one arm, namely arm (14), is used. With this crimp (400), the wire is inserted between the central section (12) and the arm (14) before crimping. This allows holding the wire (W) in place for designs where the wire (W) has the tendency to move upwards during installation, prior to crimping.

The crimped wire (40) can be crimped at the bottom of the channel between the central section (12) and the arm (14), and with sufficient force as to create a local deformation in the arm (14), such as the deformation Δh shown in FIG. 11. This deformation enhances the capability of the crimp (400) to retain the wire (W).

The crimps shown and described herein are particularly well adapted for use in an automated machine, such as the one described in U.S. patent application Ser. No. 10/631,041 filed Jul. 29, 2003, the content of which is hereby incorporated by reference. The machine is used to automatically install a length of wire between two or more crimps.

It should be noted that the various embodiments of the crimp can be modified in a number of ways. For instance, the exact shape of the crimp may be different to what is shown in the various figures. The cross-section of the side arms of the crimps may be different than rectangular. The wire-receiving groove must not necessarily be V-shaped. The side arms are not necessarily symmetrical and provided with the same length. Knobs, if provided, may have a different shape than those shown herein.

What is claimed is:

1. A collapsing bridge crimp comprising:

a central portion;

two mutually-opposite side arms extending from the central portion, each side arm comprising:

a first portion attached to the central portion, the first portion being inwardly curved;

a second portion extending from the first portion and located above the central portion, the second portion being substantially straight and defining an upwardly-oriented angle with reference to the central portion, the second portion having a free end provided with an end face, the end face of both side arms defining a top-opened wire-receiving groove between them wherein the end face of one of the side arms comprises a knob and the end face of the opposite side arm comprises a corresponding recess.

2. The crimp as defined in claim 1, wherein the wire-receiving groove has a substantially V-shaped profile.

3. The crimp as defined in claim 1, wherein each end face is substantially flat.

4. The crimp as defined in claim 1, wherein each side arm further comprises a third portion interposed between the first portion and the second portion, the third portion being outwardly curved.

5. The crimp as defined in claim 1, wherein both side arms are symmetrical.

6. The crimp as defined in claim 1, where the wire-receiving groove has a width, in a largest part thereof, between about 0.0 15" and about 0.075'.

* * * * *